US007632466B2

(12) United States Patent
Reihs et al.

(10) Patent No.: US 7,632,466 B2
(45) Date of Patent: Dec. 15, 2009

(54) ULTRAPHOBIC SURFACE STRUCTURE HAVING A PLURALITY OF HYDROPHILIC AREAS

(75) Inventors: Karsten Reihs, Cologne (DE); Wolfgang Paffhausen, Leverkusen (DE)

(73) Assignee: Qiagen GmbH, Hilden (DE)

( * ) Notice: Subject to any disclaimer, the term of this patent is extended or adjusted under 35 U.S.C. 154(b) by 456 days.

(21) Appl. No.: 10/182,722

(22) PCT Filed: Jan. 29, 2001

(86) PCT No.: PCT/EP01/00906

§ 371 (c)(1), (2), (4) Date: Nov. 13, 2002

(87) PCT Pub. No.: WO01/58688

PCT Pub. Date: Aug. 16, 2001

(65) Prior Publication Data

US 2003/0108449 A1 Jun. 12, 2003

(30) Foreign Application Priority Data

Feb. 9, 2000 (DE) ..... 100 05 600

(51) Int. Cl.
*B01L 3/00* (2006.01)

(52) U.S. Cl. ..... 422/102; 422/104

(58) Field of Classification Search ..... 422/102, 422/99, 104

See application file for complete search history.

(56) References Cited

U.S. PATENT DOCUMENTS

| | | | | | |
|---|---|---|---|---|---|
| 4,741,619 | A * | 5/1988 | Humphries et al. | ..... | 356/246 |
| 4,802,951 | A * | 2/1989 | Clark et al. | ..... | 216/56 |
| 5,229,163 | A * | 7/1993 | Fox | ..... | 204/169 |
| 5,674,592 | A * | 10/1997 | Clark et al. | ..... | 428/161 |
| 5,948,591 | A | 9/1999 | Van Damme et al. | | |
| 6,287,872 | B1 * | 9/2001 | Schurenberg et al. | ..... | 436/181 |

FOREIGN PATENT DOCUMENTS

| | | |
|---|---|---|
| DE | 196 28 928 | 1/1998 |
| DE | 198 60 138 | 12/1998 |
| DE | 198 60 140 | 12/1998 |
| DE | 198 60 135 | 6/2000 |
| DE | 198 60 136 | 6/2000 |
| DE | 198 60 139 | 7/2000 |
| WO | 96/04123 | 2/1996 |
| WO | 96/21523 | 7/1996 |
| WO | 96 34697 | 11/1996 |
| WO | 98/23549 | 6/1998 |
| WO | 98 45406 | 10/1998 |

* cited by examiner

*Primary Examiner*—Jill Warden
*Assistant Examiner*—Natalia Levkovich
(74) *Attorney, Agent, or Firm*—Oblon, Spivak, McClelland, Maier & Neustadt, L.L.P.

(57) ABSTRACT

Disclosed is an ultraphobic surface structure, especially a microtitre plate and a method for the production thereof which is provided with a plurality of hydrophilic areas which are preferably distributed on the surface in a periodic manner.

8 Claims, 7 Drawing Sheets

ULTRAPHOBIC SURFACE STRUCTURE HAVING A PLURALITY OF HYDROPHILIC AREAS

The invention concerns a surface structure with an ultraphobic surface, in particular a microtitre plate and a method for the production thereof, which is structured with a plurality of hydrophilic areas which are preferably distributed on the surface in a periodic manner. The invention also concerns the use of the surface structure as a microtitre plate or printing plate.

In the field of medicinal chemistry and also of biology it is nowadays increasingly necessary to perform series tests. Here, for example, a large number of extremely small liquid test volumes are mixed with different active ingredients in order to test the reaction of the liquid to the active ingredient in question.

Tests of this kind are performed on so-called microtitre plates. Microtitre plates are plates which have a plurality of small indentations at regular intervals, e.g. 2 mm, into which the liquid is introduced. Microtitre plates of this kind are produced by extrusion or injection moulding. However, these procedures are expensive and have a high scrap rate. As microtitre plates are single-use items, currently a relatively large amount of waste occurs which has to be disposed of.

Therefore, the object is set of providing a microtitre plate which does not have the above-mentioned drawbacks and during the production of which less waste is produced.

According to the invention, the object is achieved by the provision of a flat structure which also has ultrahydrophobic and selectively hydrophilic areas.

Figure 12:
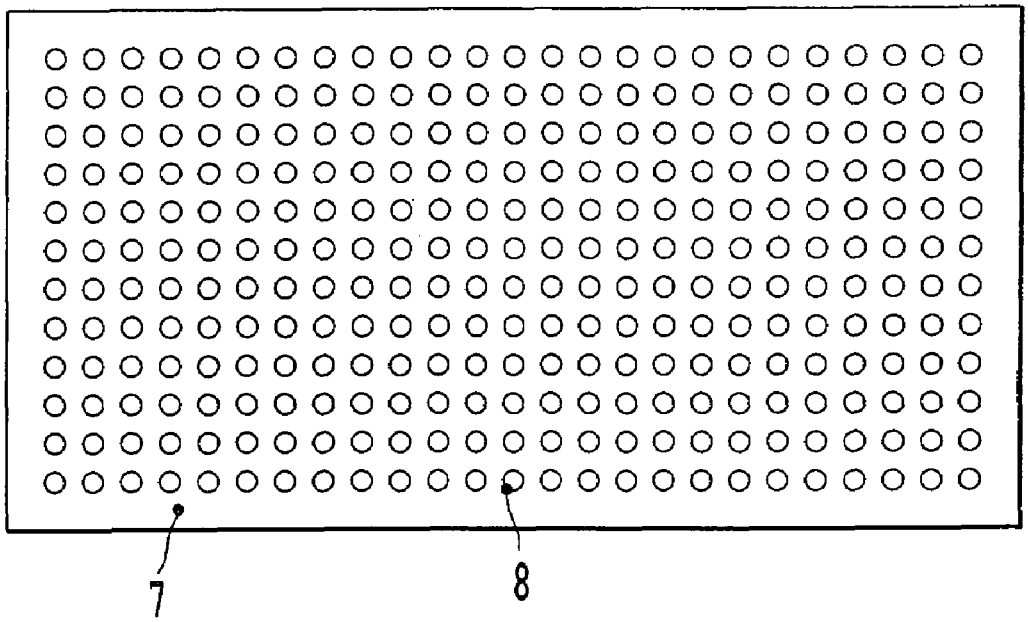

The object of the invention is a flat structure, in particular a plate, particularly preferably a microtitre plate, with a surface with ultraphobic properties, characterised in that the flat structure 7 is structured with a plurality of hydrophilic areas 8, as shown in FIG. 12.

A surface structure of this type may be a part of any moulded article. However, preferably the surface structure is a particularly flat plate.

Hydrophilic areas within the meaning of the invention are areas on which a water droplet with a size of 10 μl takes on a contact angle of <90° and the roll-off angle of the water droplet with the above-mentioned volume exceeds 10°.

Ultrahydrophobic areas for the purpose of the invention are characterised by the fact that they have an ultrahydrophobic surface on which the contact angle of a droplet of a liquid lying on the surface is significantly more than 120° C., in good cases close to 180° and the roll-off angle does not exceed 10°.

Advantageously, the hydrophilic areas are arranged on the surface so they are enclosed by the ultrahydrophobic areas. Also preferably, the hydrophilic areas only represent a small part of the overall surface. Advantageously, the hydrophilic areas are arranged uniformly on the surface so that a certain pattern is produced.

Preferred is a surface structure in which the hydrophilic areas are partially or completely distributed on the surface in a periodic manner. Particularly preferably, the hydrophilic areas distributed on the surface in a periodic manner have the same surface shape. In a particularly preferred embodiment, the surface shape of the individual hydrophilic areas is rectangular or circular. Here, the surface area of the individual hydrophilic areas is particularly preferably from 1 $nm^2$ to 1 $\mu m^2$. Preferably, the hydrophilic areas are partially or completely distributed on the surface of the surface structure so they form an image and/or character pattern.

Suitable known ultrahydrophobic surfaces have been disclosed, for example, in the publications WO 98/23549, WO 96/04123, WO 96/21523 and WO 96/34697.

In a preferred embodiment, the ultraphobic surface has a surface topography in which the value of the integral of the function $S(\log f)=a(f)\cdot f$, which gives a relationship between the spatial frequencies of the individual Fourier components and their amplitudes a(f), is between the integration limits $\log(f_1/\mu m^{-1})=-3$ and $\log(f_2/\mu m^{-1})=3$, at least 0.5, in particular 0.6 and consists of an ultraphobic material or a material which has been rendered durably ultraphobic. An ultraphobic surface of this kind is described in published German patent application DE 19860136.

In a preferred variant, the ultraphobic surface of the surface structure is an aluminum surface, which is possibly anodically oxidized, treated with water or steam, possibly coated with a layer of adhesion promoter, as described in the unpublished German application with the file reference 19860138.7. and U.S. Pat. No. 6,652,669 hereby incorporated by reference into the present disclosure. Here, the surface structure may in particular be entirely produced from aluminum or preferably have an aluminum lining, with the surface of the aluminum being treated as described above.

In another preferred variant of the surface structure according to the invention, the ultraphobic surface is a surface which is coated with $Ni(OH)_2$ particles, possibly coated with an adhesion promoter and then provided with a hydrophobic coating compound, as described in the unpublished German patent application with the file reference 19860139.5. hereby incorporated by reference into the present disclosure. Preferably, the $Ni(OH)_2$ particles have a diameter $d_{50}$ of from 0.5 to 20 μm.

In another advantageous embodiment of the invention, the ultraphobic surface is constructed from wolfram carbide, which is structured with a laser, possibly coated with an adhesion promoter and then provided with a hydrophobic coating compound, as described in published German patent application with the file reference 19860135.2. hereby incorporated by reference into the present disclosure. Preferably, the surface structure is only coated with wolfram carbide, which is then treated as described above. Particularly preferably, the wolfram carbide layer has a layer thickness ranging from 10 to 500 μm.

In another variant, the ultraphobic surface of the surface structure may be created in that the surface of the surface structure is sandblasted with a blasting agent, possibly coated with a layer of adhesion promoter and then provided with a hydrophobic coating compound as described in the unpublished German patent application with the file reference 19860140.9. hereby incorporated by reference into the present disclosure. Suitable as ultrahydrophobic or oleophobic coverings are all surface active hydrophobing agents with any molar masses.

Within the meaning of the invention, a hydrophobic material is a material which, on a level unstructured surface, has a contact angle based on water of greater than 90°.

Within the meaning of the invention, an oleophobic material is a material which, on a level unstructured surface, has a contact angle based on long-chain n-alkanes, such as n-decane, of greater than 90°.

Said integral of the function (1) is preferably >0.6.

Preference is given to an ultraphobic surface which has a contact angle towards water of at least 150°, in particular of at least 155°.

The ultraphobic surface or its substrate preferably consists of metal, plastic, glass or ceramic material. The metal is particularly preferably chosen from the series beryllium, magnesium, scandium, titanium, vanadium, chromium, manganese, iron, cobalt, nickel, copper, zinc, gallium, yttrium, zirconium, niobium, molybdenum, technetium, ruthenium, rhenium, palladium, silver, cadmium, indium, tin, lanthanum, cerium, praseodymium, neodymium, samarium, europium, gadolinium, terbium, dysprosium, holmium, erbium, thulium, ytterbium, lutetium, hafnium, tantalum, tungsten, rhenium, osmium, iridium, platinum, gold, thallium, lead, bismuth, in particular titanium, aluminum, magnesium and nickel or an alloy of said metals. The metal of the ultraphobic surface is very particularly preferably an aluminum-magnesium alloy, particularly preferably $AlMg_3$.

The polymer suitable for the ultraphobic surface or its substrate is a thermosetting or thermoplastic polymer.

The thermosetting polymer is chosen in particular from the series: diallyl phthalate resin, epoxy resin, urea-formaldehyde resin, melamine-formaldehyde resin, melamine-phenol-formaldehyde resin, phenol-formaldehyde resin, polyimide, silicone rubber and unsaturated polyester resin.

The thermoplastic polymer is chosen in particular from the series: thermoplastic polyolefin, e.g. polypropylene or polyethylene, polycarbonate, polyester carbonate, polyester (e.g. PBT or PET), polystyrene, styrene copolymer, SAN resin, rubber-containing styrene graft copolymer, e.g. ABS polymer, polyamide, polyurethane, polyphenylene sulphide, polyvinyl chloride or any possible mixtures of said polymers.

The thermoplastic polymers below are particularly suitable as substrate for the surface according to the invention:

polyolefins, such as polyethylene of high and low density, i.e. densities of 0.91 g/cm$^3$ to 0.97 g/cm$^3$, which can be prepared by known processes, Ullmann (4th) 19, page 167 et seq., Winnacker-Kuchler (4th) 6, 353 to 367, Elias & Vohwinkel, Neue Polymere Werkstoffe fur die industrielle Anwendung, Munich, Hanser 1983.

Also suitable are polypropylenes with molecular weights of from 10 000 g/mol to 1 000 000 g/mol, which can be prepared by known processes, Ullmann (5th) A10, page 615 et seq., Houben-Weyl E20/2, page 722 et seq., Ullmann (4th) 19, page 195 et seq., Kirk-Othmer (3rd) 16, page 357 et seq.

However, copolymers of said olefins or with further α-olefins are also possible, slid as, for example, polymers of ethylene with butene, hexene and/or octene, EVA (ethylene-vinyl acetate copolymers), EBA (ethylene-ethyl acrylate copolymers), EEA (ethylene-butyl acrylate copolymers), EAS (acrylic acid-ethylene copolymers), EVK (ethylene-vinylcarbazole copolymers), EPB (ethylene-propylene block copolymers) EPDM (ethylene-propylene-diene copolymers), PB (polybutylenes), PMP (polymethylpentenes), PIB (polyisobutylenes), NBR (acrylonitrile-butadiene copolymers) polyisoprenes, methyl-butylene copolymers, isoprene-isobutylene copolymers.

Preparation processes: such polymers are disclosed, for example, in Kunststoff-Handbuch [Polymer Handbook], Volume IV, Munich, Hanser Verlag, Ullman (4th) 19, page 167 et seq.; Winnacker-Kuchler (4th) 6, 353 to 367; Elias & Vohwinkel, Neue Polymere Werkstoffe [Novel Polymeric Materials] Munich, Hanser 1983; and Franck & Biederbick, Kunststoff Kompendium [Polymer Compendium] Wiirzburg Vogel 1984.

Thermoplastic polymers suitable according to the invention are also thermoplastic aromatic polycarbonates, in particular those based on diphenols of the formula (I)

(I)

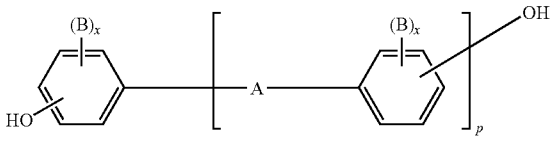

in which

A is a single bond, $C_1$-$C_5$-alkylene, $C_2$-$C_5$-alkylidene, $C_5$-$C_6$-cycloalkylidene —S—, —$SO_2$—, —O—, —CO— or a $C_6$-$C_{12}$-arylene radical which may optionally be condensed with further aromatic rings containing heteroatoms, the radicals B, independently of one another, are in each case a $C_1$-$C_8$-alkyl $C_6$-$C_{10}$-aryl, particularly preferably phenyl, $C_7$-$C_{12}$-aralkyl, preferably benzyl halogen, preferably chlorine, bromine, x independently of one another is in each case 0, 1 or 2 and p is 1 or 0, or alkyl-substituted dihydroxyphenylcycloalkanes of the formula (II), (II)

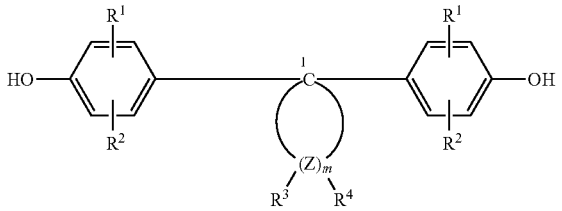

in which $R_1$ and $R_2$, independently of one another, are in each case hydrogen, halogen, preferably chlorine or bromine, $C_1$-$C_8$-alkyl, $C_5$-$C_6$-cycloalkyl, $C_6$-$C_{10}$-aryl, preferably phenyl, and $C_7$-$C_{12}$-aralkyl, preferably phenyl-$C_1$-$C_4$-alkyl, in particular benzyl, m is an integer from 4 to 7, preferably 4 or 5, $R_3$ and $R_4$ for each Z can be chosen individually and are, independently of one another, hydrogen or $C_1$-$C_6$-alkyl, preferably hydrogen, methyl or ethyl, and Z is carbon, with the proviso that on at least one atom Z, $R^3$ and $R^4$ are alkyl at the same time.

Suitable diphenols of the formula (I) are, for example, hydroquinone, resorcinol, 4,4'-dihydroxydiphenyl, 2,2-bis-(4-hydroxyphenyl)-propane, 2,4-bis-(4-hydroxyphenyl)-2-methylbutane, 1,1-bis-(4-hydroxyphenyl)-cyclohexane, 2,2-bis-(3-chloro-4-hydroxyphenyl)-propane, and 2,2-bis-(3,5-dibromo-4-hydroxyphenyl)-propane. Preferred diphenols of the formula (I) are 2,2-bis-(4-hydroxyphenyl)-propane. 2,2-bi (3,5-dichloro-4-hydroxyphenyl)-propane and 1,1-bis-(4-hydroxyphenyl)-cyclohexane.

Preferred diphenols of the formula (II) are dihydroxydiphenylcycloalkanes having 5 and 6 ring carbon atoms in the cycloaliphatic radical [(m=4 or 5 in formula (II)], such as, for example, the diphenols of the formulae (IIa)

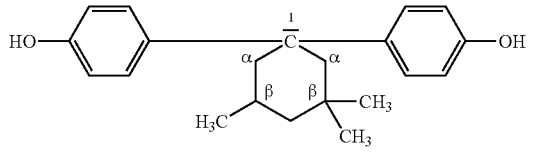

(IIb)

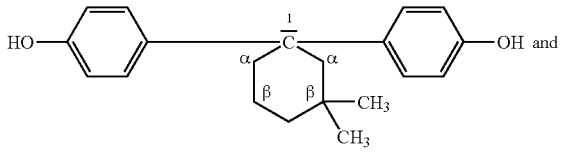

and (IIc)

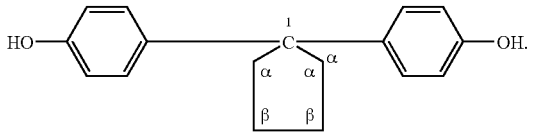

1,1-bis-(4-hydroxyphenyl)-3,3,5-trimethylcyclohexyne (formula IIc) being particularly preferred.

The polycarbonates suitable according to the invention can be branched in a known manner, and more specifically, preferably by the incorporation of from 0.05 to 2.0 mol %, based on the sum of diphenols used, of tri- or more than trifunctional compounds, e.g. those with three or more than three phenolic groups, for example phloroglucinol, 4,6-dimethyl-2,4,6-tri-(4-hydroxyphenyl)-hept-2-ene, 4,6-dimethyl-2,4,6-tri-(4-hydroxyphenyl)-heptane, 1,3,5-tri-(4-hydroxyphenyl)-benzene, 1,1,1-tri-(4-hydroxyphenyl)-ethane, tri-(4-hydroxyphenyl)-phenylmethane, 2,2-bis-(4,4-bis-(4-hydroxyphenyl)-cyclohexyl)-propane, 2,4-bis-(4-hydroxyphenyl)-isopropyl)-phenol, 2,6-bis-(2-hydroxy-5'-methyl-benzyl)-4-methylphenol, 2-(4-hydroxyphenyl)-2-(2,4-dihydroxyphenyl)-propane, hexa-(4-(4-hydroxyphenyl-isopropyl)-phenyl) ortho-terephthalate, tetra-(4-hydroxyphenyl)-methane, tetra-(4-(4-hydroxyphenyl-isopropyl)-phenoxy)-methane and 1,4-bis-((4'-,4"-dihydroxytriphenyl)-methyl)-benzene.

Some of the other trifunctional compounds are 2,4-dihydroxybenzoic acid, trimesic acid, trimellitic acid, cyanuric chloride and 3,3-bis-(3-methyl-4-hydroxyphenyl)-2-oxo-2,3-dihydroindole.

Preferred polycarbonates are, in addition to the bisphenol A homopolycarbonate, the copolycarbonates of bisphenol A containing up to 15 mol %, based on the mole total of diphenols, of 2,2-bis-(3,5-dibromo-4-hydroxyphenyl)-propane.

The aromatic polycarbonates used can partially be replaced by aromatic polyester 5 carbonates.

Aromatic polycarbonates and/or aromatic polyester carbonates are known in the literature and can be prepared by processes known in the literature (for the preparation of aromatic polycarbonates see, for example, Schnell, "Chemistry and Physics of Polycarbonates", Interscience Publishers, 1964, and DE-AS (German Published Specification) 1 495 626, DE-OS (German Published Specification) 2 232 877, DE-OS (German Published Specification) 2 703 376, DE-OS (German Published Specification) 2 714 544, DE-OS (German Published Specification) 3 000 610, DE-OS (German Published Specification) 3 832 396; for the preparation of aromatic polyester carbonates e.g. DE-OS (German Published Specification) 3 077 934).

Aromatic polycarbonates and/or aromatic polyester carbonates can be prepared, for example, by reacting diphenols with carbonic acid halides, preferably phosgene and/or with aromatic dicarboxylic acid dihalides, preferably benzenedicarboxylic acid dihalides, by the phase interface method, optionally using chain terminators and optionally using trifunctional or more than trifunctional branching agents.

In addition, styrene copolymers of one or at least two ethylenically unsaturated monomers (vinyl monomers) are suitable as thermoplastic polymers, such as, for example, those of styrene, α-methylstyrene, ring-substituted styrenes, acrylonitrile, methacrylonitrile, methyl methacrylate, maleic anhydride, N-substituted maleimides and (meth)acrylates having 1 to 18 carbon atoms in the alcohol component. The copolymers are resinous, thermoplastic and rubber-free. Preferred styrene copolymers are those comprising at least one monomer from the series styrene, α-methylstyrene and/or ring-substituted styrene with at least one monomer from the series acrylonitrile, methacrylonitrile, methyl methacrylate, maleic anhydride and/or N-substituted maleimide.

Particularly preferred weight ratios in the thermoplastic copolymer are 60 to 95% by weight of the styrene monomers and 40 to 5% by weight of the further vinyl monomers. Particularly preferred copolymers are those of styrene with acrylonitrile and optionally with methyl methacrylate, of α-methylstyrene with acrylonitrile and optionally with methyl methacrylate, or of styrene and α-methylstyrene with acrylonitrile and optionally with methyl methacrylate.

The styrene-acrylonitrile copolymers are known and can be prepared by free-radical polymerization, in particular by emulsion, suspension, solution or bulk polymerization. The copolymers preferably have molecular weights $\overline{M}_w$ (weight-average, determined by light scattering or sedimentation) between 15 000 and 200 000 g/mol.

Particularly preferred copolymers are also random copolymers of styrene and maleic anhydride, which can preferably be prepared from the corresponding monomers by continuous bulk or solution polymerization with incomplete conversions. The proportions of the two components of the random styrene-maleic anhydride copolymers suitable according to the invention can be varied within wide limits. The preferred content of maleic anhydride is 5 to 25% by weight. Instead of styrene, the polymers can also contain ring-substituted styrenes, such as p-methylstyrene, 2,4-dimethylstyrene and other substituted styrenes, such as α-methylstyrene.

The molecular weights (number-average $\overline{M}_n$) of the styrene-maleic anhydride copolymers can vary over a wide range. Preference is given to the range from 60 000 to 200 000 g/mol. For these products, a limiting viscosity of from 0.3 to 0.9 is preferred (measured in dimethylformamide at 25° C.; see Hoffmann, Krömer, Kuhn, Polymeranalytik I, Stuttgart 1977, page 316 et seq.).

Also suitable as thermoplastic polymers are graft copolymers. These include graft copolymers having rubber-elastic properties which are essentially obtainable from at least 2 of the following monomers: chloroprene, 1,3-butadiene, isopropene, styrene, acrylonitrile, ethylene, propylene, vinyl acetate and (meth)acrylates having 1 to 18 carbon atoms in the alcohol component; i.e. polymers as described, for example, in "Methoden der Organischen Chemie" [Methods in Organic Chemistry] (Houben-Weyl), vol. 14/1, Georg Thieme Verlag, Stuttgart 1961, p. 393-406 and in C. B. Bucknall, "Toughened Plastics", Appl. Science Publishers, London 1977. Preferred graft polymers are partially crosslinked and have gel contents of more than 20% by weight, preferably more than 40% by weight, in particular more than 60% by weight.

Preferred graft copolymers are, for example, copolymers of styrene and/or acrylonitrile and/or alkyl (meth)acrylates grafted onto polybutadienes, butadiene/styrene copolymers and acrylate rubbers; i.e. copolymers of the type described in DE-OS (German Published Specification) 1 694 173 (=U.S. Pat. No. 3,564,077); polybutadienes, grafted with alkyl acrylates or methacrylates, vinyl acetate, acrylonitrile, styrene and/or alkylstyrenes, butadiene-styrene or butadiene-acrylonitrile copolymers, polyisobutenes or polyisoprenes, as described, for example, in DE-OS (German Published Specification) 2 348 377 (=U.S. Pat. No. 3,919,353).

Particularly preferred polymers are, for example, ABS polymers, as are described, for example, in DE-OS (German Published Specification) 2 035 390 (=U.S. Pat. No. 3,644,574) or in DE-OS (German Published Specification) 2 248 242 (=GB Patent 1 409 275).

The graft copolymers can be prepared by known processes such as bulk, suspension, emulsion or bulk-suspension processes.

Thermoplastic polyamides which may be used are polyamide 66 (polyhexamethylene adipamide) or polyamides of cyclic lactams having 6 to 12 carbon atoms, preferably of laurolactam and particularly preferably c-caprolactam=polyamide 6 (polycaprolactam) or copolyamides with main constituents 6 or 66 or mixtures whose main constituent is said polyamides. Preference is given to polyamide 6 prepared by activated anionic polymerization or to copolyamide whose main constituent is polycaprolactam and which is prepared by activated anionic polymerization.

Suitable ceramic materials are metal oxides, metal carbides, metal nitrides of the abovementioned metals, and composites of these materials.

The surface topography of any surface can in principle be described by a combination of Fourier components of the spatial frequencies $f_x$ and $f_y$ and the amplitudes $a(f_x)$ and $a(f_y)$ associated with the frequencies. $\lambda_x=f_x^{-1}$ and $\lambda_y=f_y^{-1}$ are the structure lengths of coordinates x and y.

In the technology the use of the so-called power spectral density $S_2(f_x, f_y)$ is customary. The averaged power spectral density is proportional to the average of all quadratic amplitudes at the respective spatial frequencies $f_x$ and $f_y$. If the surface is isotropic, the surface topography can be characterized by a power spectral density PSD(f) averaged over the polar angle. The power spectral density PSD(f) is still a two-dimensional function of the dimension $[\text{length}]^4$, although both directions are identical and only one is taken into consideration. This calculation is described, for example, in the publication by C. Ruppe and A. Duparré, Thin Solid Films, 288, (1996), page 9 in equation (2).

Depending on which measurement method is used to determine the topography, the power spectral density results directly, or has to be converted to the power spectral density PSD(f) by means of a Fourier transformation of height profile data of the topography. This conversion is described, for example, in the publication by C. Ruppe and A. Duparré, Thin Solid Films, 288, (1996), page 9, which is hereby introduced as reference and thus forms part of the disclosure.

The surface topography of an ultraphobic surface under a drop of liquid has raised areas and depressions, the height or depth of which vary between 0.1 nm and 1 mm. Because of this enormous bandwidth it is currently still not possible to determine the surface topography using a single measurement method, meaning that 3 measurement and evaluation methods have to be combined with one another in order to be able to precisely determine the surface topography. These measurement methods are:

1. white light interferometry (WLI)
2. scanning atomic force microscopy (AFM)
3. scanning tunneling microscopy (STM).

Using these measurement methods, the PSD(f) is determined in each case section by section in relatively narrow overlapping spatial frequency ranges Δf. This power spectral density determined section by section is then combined to give the overall PSD(f) in the spatial frequency range from $f=10^{-3}\ \mu m^{-1}$ to $f=10^{3}\ \mu m^{-1}$. The technique of combining PSD curves determined section by section is shown, for example, in C. Ruppe and A. Duparré, Thin Solid Films, 288, (1996), page 10, which is hereby introduced as reference and thus forms part of the disclosure.

White light interferometry (WLI) is used to determine the power spectral density in the spatial frequency range from $\Delta f=1\times10^{-3}\ \mu m^{-1}$-$1\ \mu m^{-1}$, where:

with the measurement field: 1120 μm×1120 μm, a spatial frequency range from: $\Delta f=9\times10^{-4}\ \mu m^{-1}$ to $2\times10^{-1}\ \mu m^{-1}$ is measured, with the measurement field: 280 μm×280 μm, a spatial frequency range from: $\Delta f=4\times10^{-3}\ \mu m^{-1}$ to $9\times10^{-1}\ \mu m^{-1}$ is measured, with the measurement field: 140 μm×140 μm, a spatial frequency range from: $\Delta f=7\times10^{-3}\ \mu m^{-1}$ to $2\times100\ \mu m^{-1}$ is measured.

In this measurement method, a height profile z(x,y) is determined using a white light interferometer, where z is the height over any desired reference height $z_0$ at the 0 respective site x or y. The exact experimental design and the measurement method can be found in R. J. Recknagel, G. Notni, Optics Commun. 148, 122-128 (1998), The height profile z(x,y) is converted analogously to the procedure in the case of scanning atomic force microscopy or scanning tunneling microscopy described below.

Scanning atomic force microscopy (AFM) is used to determine the power spectral density in the spatial frequency range $\Delta f=1\times10^{-2}\ \mu m^{-1}$-$1\times10^{2}\ \mu m^{-1}$ and is e measurement method generally known to the person skilled in the art in which a height profile $z_{m,n}$ of the surface is recorded in the contact or tapping mode using a scanning atomic force microscope. For this measurement method, different scar areas L×L are used. These scan areas and the number of datapoints N are used to calculate the minimum or maximum spatial frequency which can be investigated pet scan area, where the following applies: $f_{max}=N/2\ L$ or $f_{min}=1/L$. Preferably, 512 measurement points are used per scan area, so that in the scan area 50 μm×50 μm, a spatial frequency range of:

$\Delta f=2\times10^{-2}\ \mu m^{-1}$ to $5\ \mu m^{-1}$ is measured, in the scan area 10 μm×$10^1$ μm, a spatial frequency range of:

$\Delta f=1\times10^{-1}\ \mu m^{-1}$ to $3\times10^{1}\ \mu m^{-1}$ is measured, and in the scan area 1 μm×1 μm a spatial frequency range of:

$\Delta f=1\ \mu m^{-1}$ to $3\times10^{2}\ \mu m^{-1}$ is measured.

The height profile $z_{m,n}$, is based on an arbitrary reference height $z_0$. m, n are measurement points in the x or y direction recorded at equidistant spacing ΔL. The height profile data are converted into the averaged power spectral density PSD in accordance with equations 1 and 2 of the publication by C. Ruppe and A. Duparré, Thin Solid Films, 288, (1996), page 9.

Scanning tunneling microscopy (STM) is used to determine the power spectra] density in the spatial frequency range $\Delta f=1\times10^{1}$-$1\times10^{3}\ \mu m^{-1}$ and is z measurement method generally known to the person skilled in the art in which a height profile $z_{m,n}$ of the surface is recorded using a scanning tunneling microscope.

In this measurement method too, different scan areas L×L are used. These scan areas and the number of datapoints N are used to calculate the minimum or maximum spatial frequency which can be investigated per scan area, where the following applies:

$f_{max}$ N/2 L or $f_{min}$=1/L. Preferably, 512 measurement points are used per scan area, so that in the scan area 0.5×0.5 μm, a spatial frequency range of:

$\Delta f=2\ \mu m^{-1}$ to $5\times10^2\ \mu m^{-1}$ is measured, scan area 0.2 μm×0.2 μm, a spatial frequency range of:

$\Delta f=5\ \mu m^{-1}\times$ to $1\times10^3\ \mu m^{-1}$ is measured, scan area 0.1 μm×0.1 μm a spatial frequency range of:

$\Delta f=1\times10^{-1}\ \mu m^{-1}$ to $3\times10^3\ \mu m^{-1}$ is measured.

The height profile $z_{m,n}$ is based on an arbitrary reference height $z_0$. m, n are measurement points in the x or y direction recorded at equidistant spacing ΔL. The height profile data are converted to the averaged power spectral density PSD according to equations 1 and 2 of the publication by C. Ruppe and A. Duparré, Thin Solid Films, 288, (1996), page 9.

The exact experimental design and carrying out of AFM and STM measurements is described, for example in the publication by S. N. Magonov, M.-H. Whangbo, Surface Analysis with STM and AFM, VCH, Weinheim 1996, in particular on pages 47-62.

The PSD curves obtained by the various measurement methods or with the various scan areas are combined to give a PSD(f) curve in the spatial frequency range from $10^{-3}\ \mu m^{-1}$ to $10^3\ \mu m^{-1}$. The PSD(f) curve is constructed in accordance with a procedure as described in C. Ruppe and A. Duparré, Thin Solid Films, 288, (1996), page 10-11. FIGS. 1-4 show the result for PSD(f) curves in log-log representation, plotted as $\log(PSD(f)/nm^4)$ as a function of $\log(f/\mu m^{-1})$.

Power spectral densities of this type have also been known for some time for many other surfaces and can be used for very different purposes, cf. e.g. J. C. Stover, Optical Scattering, 2nd Edition, SPIE Press, Bellingham, Wash., USA 1995, Chapter 2, page 29 et seq. and Chapter 4, page 85 et seq.

In order to achieve a better illustration of the topography of the surfaces for the purposes pursued here, a spatial-frequency-dependent amplitude a(f) of the sinusoidal Fourier components is calculated from the power spectral densities PSD(f). For this, the formulae (4.19) on page 103 and Table 2.1 on page 34 and Table 2.2 on page 37 from J. C. Stover, Optical Scattering, 2nd Edition, SPIE Press, Bellingham, Wash., USA 1995 are used.

The amplitudes a(f) of the sinusoidal Fourier components normalized with the associated structural lengths $\lambda=f^1$ are plotted in FIGS. 5-8 against the logarithmic spatial frequency $\log(f/\mu m^{-1})$ in the function S as $$S(\log f)=a(f)\cdot f \quad (1).$$

The invention is based on the surprising finding that a surface which is provided with a structure for which the integral of the function S(log f)=a(f) f calculated between the integration limits $f_1/\mu m^{-1}=-3$ and $f_2/\mu m^{-1}=3$, is greater than 0.5 and which consists of a hydrophobic material or is coated with hydrophobic material has ultraphobic properties, such that a drop of water on this surface generally has a contact angle of >150°.

This entirely surprising new finding permits the prediction of many details regarding possible process steps in the preparation of ultraphobic surfaces. The core statement of the finding is as follows: FIGS. 5-8 show the structural amplitudes a(f)·f normalized with the wavelengths $\lambda=f^1$ for various frequencies f on the logarithm frequency scale log(f). A value for a(f)·f=0.5 means, for example, that the normalized amplitude, i.e. the "roughness" of this Fourier component is 0.5-fold wavelength $\lambda=f^1$. The integral of equation (1) thus states that

- the average of all normalized amplitudes a(f)·f for the individual different frequencies must exceed a value of 0.5, i.e. the roughness averaged over all frequencies must be maximized in order to obtain an ultraphobic surface.
- different spatial frequencies are included in this sum with equal weighting (by virtue of the log(f) representation). It is therefore unimportant in which frequency range the individual roughnesses lie.

On the basis of this finding, the person skilled in the art knows that, for example, the roughening of a surface using conical particles of uniform size is unfavourable. What is favourable, however, is the additional roughening of the particle surfaces using smaller structures, e.g. using small particles which rest on or adhere to the large particles, but which are not present separately alongside the large particles.

In addition, it is clear that, for example during the roughening of a surface introducing scratches (e.g. by means of abrasive particles), it is to be ensured that the depressions of a scratch must for their part be again as rough as possible within the next dimensional order of magnitude. If this is not the case, the primary depressions are for their part to be roughened again in a further operation.

In this connection, it may be noted that the new finding described here makes no limitation with regard to the shape or the profile of the depressions or rough structures. In the case of the example of rough particles which are applied to a surface and which form the necessary structure for an ultraphobic surface, it is possible for the finer substructures on the particles themselves to have a complete differently shape (i.e. another spatial frequency spectrum) from the structure which the particles themselves form on the surface.

Moreover, the determination of frequency-dependent amplitudes of the Fourier components with the help of the power spectral density in the abovementioned form opens up an unknown possibility of testing different materials with completely different surface structures with regard to their ultraphobic property and of achieving a characterization.

The invention further provides a method of testing surfaces for ultraphobic properties, characterized in that the surface is coated with a thin layer of noble metal or GaAs as adhesion promoter, in particular with gold, in particular in a layer thickness of from 10 to 100 nm, by atomization, is coated with a phobicization auxiliary, preferably with decanethiol, then the surface topography is analysed, in particular using a combination of scanning tunneling microscopy, scanning atomic force microscopy and white light interferometry and, from the measured data, the spatial frequencies f of the individual Fourier components and their amplitudes a(f) expressed by the integral of the function S $$S(\log f)=a(f)\cdot f \quad (1),$$

calculated between the integration limits $\log(f_1/\mu m^{-1})=-3$ and $\log(f_2/\mu m^{-1})=3$ is formed and, optionally in addition the contact angle of water on the surface thus treated is measured.

By virtue of the coating with an adhesion promoter (typically gold from 10 to 100 nm) and the choice of a consistent phobicization agent, it is possible to investigate many different materials whose surface is in principle suitable for developing ultraphobic surface properties, irrespective of the material. Thus, different surface structures are comparable with one another.

Preference is given to an ultraphobic surface characterized in that the surface has a coating with a hydrophobic phobicization auxiliary, in particular an anionic, cationic, amphoteric or nonionic, interface-active compound.

Suitable as hydrophobing agents are all surface active substances with any molar masses. These compounds are preferably cationic, anionic, amphoteric or non-ionic surface-active compounds, such as those listed in the directory "Surfactants Europa, A Dictionary of Surface Active Agents available in Europe, Edited by Gordon L. Hollis, Royal Society of Chemistry, Cambridge, 1995", for example. Examples of anionic hydrophobing agents are: alkyl sulfates, ether sulfates, ether carboxylates, phosphate esters, sulfosuccinates, sulfosuccinate amides, paraffin sulfonates, olefin sulfonates, sarcosinates, isothionates, taurates and lignin compounds. Examples of cationic hydrophobing agents are quaternary alkyl ammonium compounds and imidazoles. Examples of amphoteric hydrophobing agents are betaines, glycinates, propionates and imidazoles. Examples of non-ionic hydrophobing agents are: alkoxylates, alkylamides, esters, amine oxides and alkylpolyglycosides. Also eligible are: conversion products of alkylene oxides with alkylatable compounds, such as, for example, fatty alcohols, fatty amines, fatty acids, phenols, alkylphenols, aryl alkylphenols, such as styrene-phenol condensates, carboxylic acid amides and resin acids.

Particularly preferred are hydrophobing agents in which 1 to 100%, particularly preferably 60 to 95% of the hydrogen atoms are substituted by fluorine atoms. Examples mentioned are perfluorinated alkyl sulfate, perfluorinated alkyl sulfonates, perfluorinated alkyl phosphates, perfluorinated alkyl phosphinates and perfluorinated carboxylic acids.

Preferably, compounds with a molar mass $M_w$ of >500 W to 1,000,000, preferably 1,000 to 500,000 and particularly preferably 1,500 to 20,000 are used as polymer hydrophobing agents for the hydrophobic coating or as polymer hydrophobic material for the surface. These polymer hydrophobing agents may be non-ionic, anionic, cationic or amphoteric compounds. In addition, these polymer hydrophobing agents may be homo- and copolymers, graft polymers and graft copolymers and statistical block polymers.

Particularly preferred polymeric hydrophobing agents are those of the AB-, BAB- and ABC block copolymer types. In the AB, or BAB block polymers, the A segment is a hydrophilic homopolymer or copolymer and the B-block a hydrophobic homopolymer or copolymer or a salt thereof.

Particularly preferred are also anionic, polymeric hydrophobing agents, in particular condensation products or aromatic sulfonic acids with formaldehyde and alkylnaphthalene sulfonic acids or from formaldehyde, naphthalene sulfonic acids and/or benzene sulfonic acids, condensation products from possibly substituted phenol with formaldehyde and sodium bisulfite.

Also preferred are condensation products which may be obtained by the conversion of naphthalene with alkanols, additions of alkylene oxide and at least partial conversion of the terminal hydroxy groups into sulfo groups or semi-esters of maleic acid and phthalic acid or succinic acid.

In another preferred embodiment, the hydrophobing agent comes from the group of sulfosuccinic acid esters and alkyl benzene sulfonates. Also preferred are sulphated, alkoxylated fatty acids or their salts. Alkoxylated fatty acid alcohols should be understood to mean $C_6$-$C_{22}$ fatty acids, in particular those with 5 to 20, with 6 to 60, most preferably with 7 to 30 ethylene oxide units which are saturated or unsaturated, in particular stearyl alcohol. The sulphated alkoxylated fatty acid alcohols preferably occur as salts, in particular as alkali or amine salts, preferably as diethylamine salts.

The surfaces according to the invention are advantageously produced in that a surface structure with an ultraphobic surface is destroyed and hydrophilised locally at the points at which the surface should be hydrophilic.

The surface according to the invention may be used in all areas in which it is desirable for water or water-containing substances only partially to wet a surface. The surface structure may be used particularly advantageously as a printing plate or a microtitre plate.

If the surface structure is used as a printing plate, the ultrahydrophobic layer of the surface is selectively destroyed and hydrophilised in the areas in which the printing ink is to adhere.

If the surface is used as microtitre plate, the ultrahydrophobic layer is destroyed in a plurality of places. These places have, for example, an area of the order of magnitude of from 1 $nm^2$ to 1 $\mu m^2$ and are preferably arranged at regular distances of a few mm from each other.

A microtitre plate of this type has the following advantages:

- the volume of the water droplets may be easily monitored by measuring the diameter of the spherical droplets
- the production of the microtitre plate is simpler than it is in the prior art. In this example, the laser structuring may also be very easily integrated in the automatic metering units.
- the microtitre plates may be sold in the form of simple films, which the customer may use flexibly in a suitable grating and a suitable field size.
- The test volumes are freely accessible drops which may be approached and scanned with detection devices.
- The drop volumes may be easily reduced to the range of 1 nl. This enables the surface density to be clearly increased compared to conventional microtitre plates.
- the amount of material required to produce a microtitre plate is less than that in prior art. Less waste is produced after the use of this single-use article.

The surface structure according to the invention is simple and inexpensive to produce. It may, for example, be produced as a film and bonded to any moulded article as a substrate. Consequently, the film may be sold as a microtitre plate, with after its use, only the film, and not the entire moulded article to which it was applied, having to be disposed of.

Another subject of the invention is the use of the surface structure according to the invention as a printing plate, in particular for black-white printing or multi-coloured printing.

The subject of the invention is also the use of the surface structure as a microtitre plate.

Another subject of the invention is a procedure for the production of a surface structure according to the invention by the selective removal of an ultraphobic surface layer on a hydrophilic substrate at the places which are to form hydrophilic areas, in particular by mechanical or chemical stripping, in particular by laser radiation of a suitable intensity.

With the invention according to the procedure, the hydrophilic areas on a plate may be kept very small and positioned very precisely, so that the surface density of the test volumes may be significantly reduced compared to microtitre plates according to prior art.

The invention will be further described with the examples, which do not, however, represent a restriction of the invention.

Instead of using the integral of the function S $$S(\log f)=a(f):f \quad (1)$$

within the limits $\log(f_1/\mu m^{-1})=-3$ and $\log(f_2/\mu m^{-1})=3$ with a value greater than 0.5 for the description of the ultraphobic surface, it is also possible to use the integral of the function F $$F(\log f)=3+\log(a(f)\cdot f) \quad (2),$$

in the interval $\log(f_1/\mu m^{-1})=-3$ to $\log(f_2\ \mu m^{-1})=3$. In the range of positive values for F, the value of this integral must be greater than 5 in order to produce a surface having ultraphobic properties. The description using the function F has already been used in German patent 19860136.

However, the description (1) using the function S has the advantage that the value of the integral of S(log f) is very clear. This is because it is proportional to the normalized amplitude of all Fourier components $<a(f)\cdot f$ averaged on a logarithmic frequency scale in the interval $-3\leqq\log(f/\mu m^{-1})\leqq 3$. Thus, the condition found for the preparation of ultraphobic surfaces is, in brief: the normalized average of all Fourier amplitudes $<a(f)\cdot f$ determined on a logarithmic frequency scale must be greater than 0.5/6=0.08. For an "average" frequency, the Fourier amplitude should thus be at least about 8% of the structural length.

Figure 10:
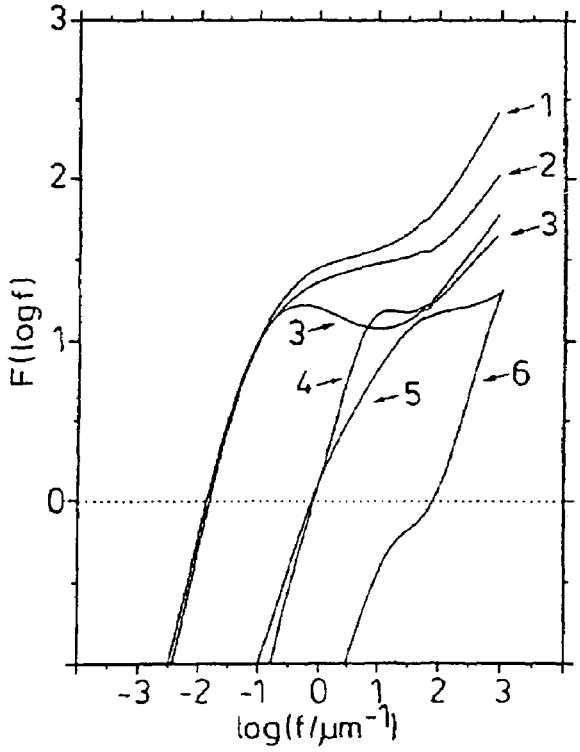
Figure 11:
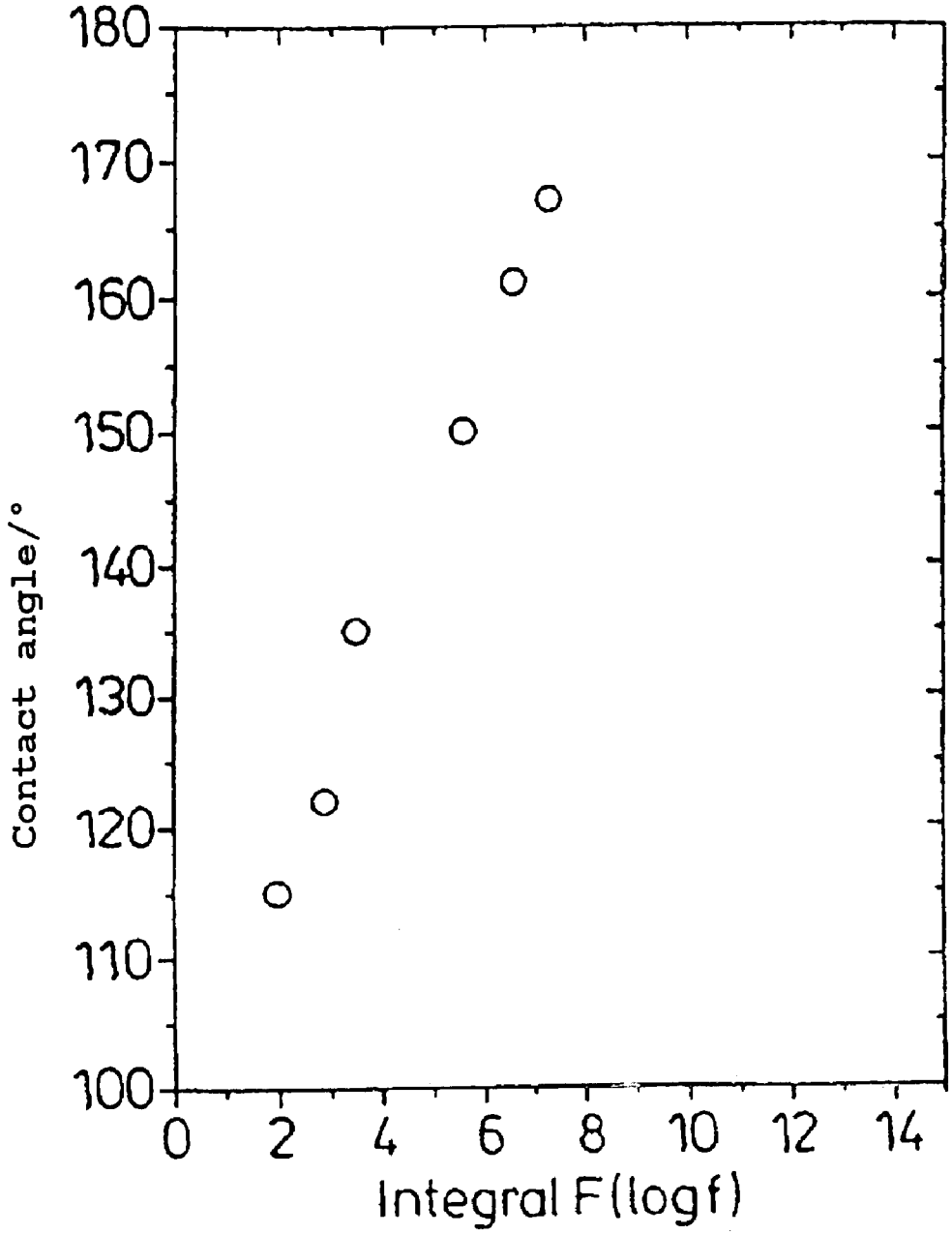

In order to show the comparability of the two descriptions (1) and (2), Examples 1-6 are given at the end in FIGS. 10 and 11 additionally with the help of the function F, as in published German application DE 19860136 (U.S. application Ser. No. 09/869,123).

The invention is illustrated below in the examples with reference to figures.

Figure 1:
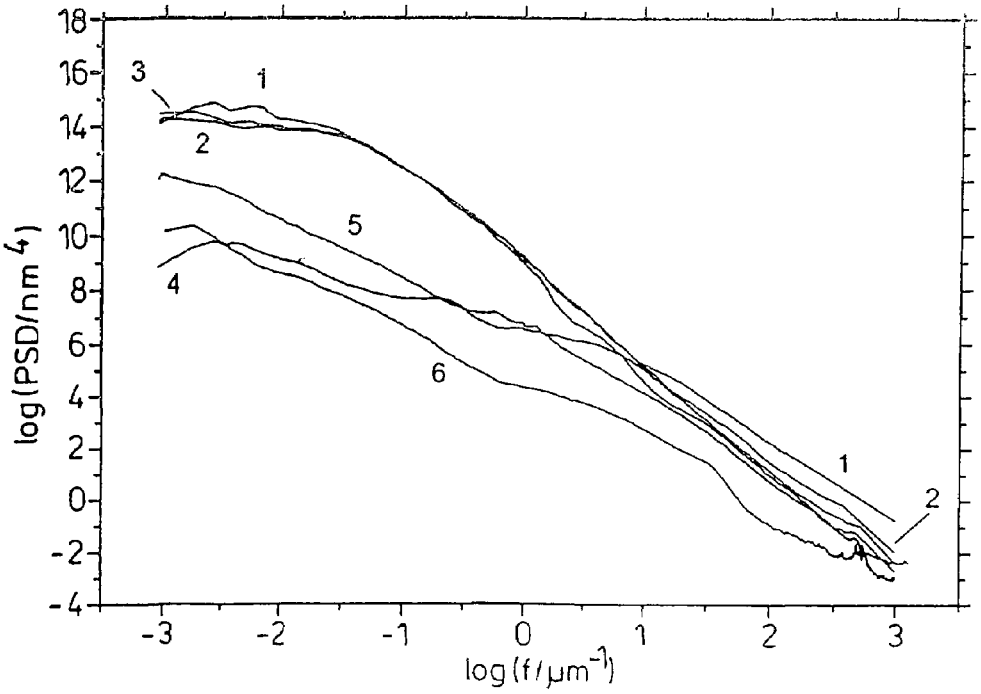

FIG. 1 representation of the PSD(f) curves of ultraphobic surfaces according to the invention of Examples 1-6

Figure 2:
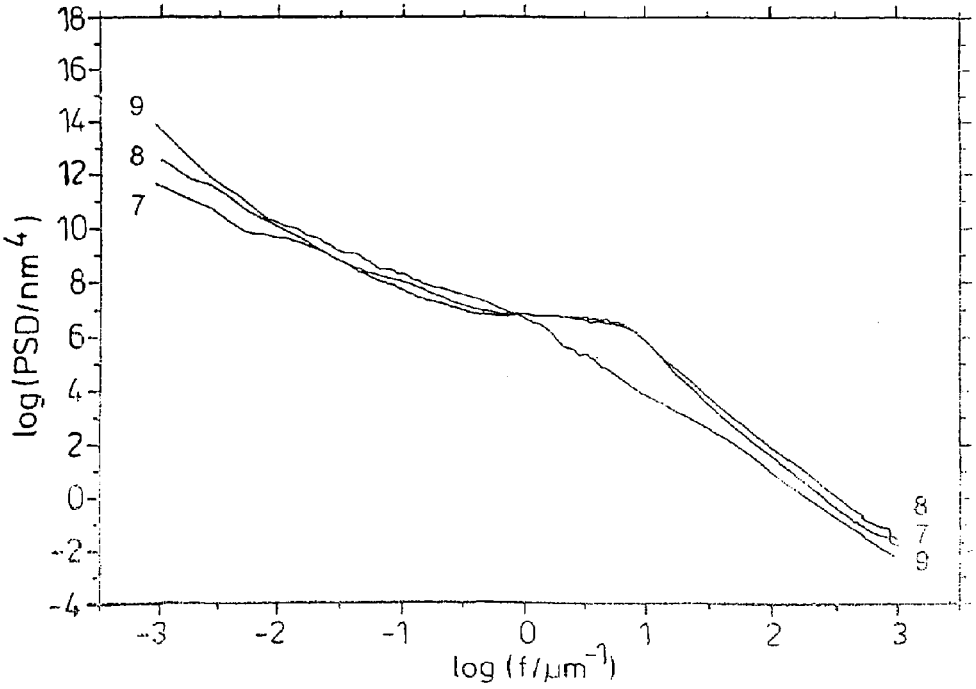

FIG. 2 representation of the PSD(f) curves of ultraphobic surfaces according to the invention of Examples 7-9

Figure 3:
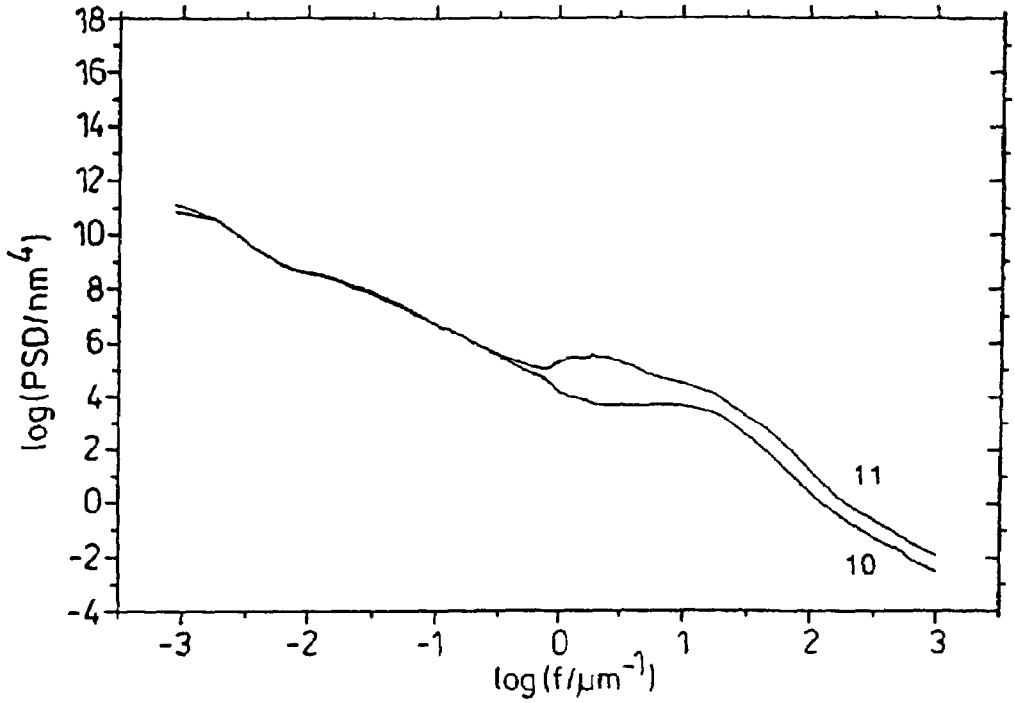

FIG. 3 representation of the PSD(f) curves of ultraphobic surfaces according to the invention of Examples 10-11

Figure 4:
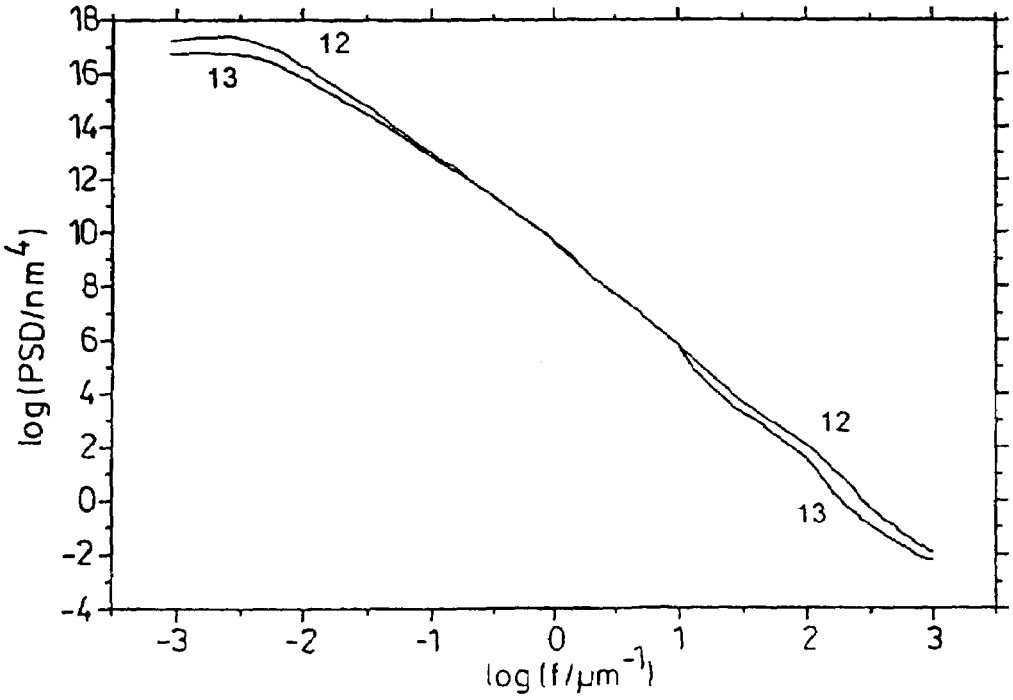

FIG. 4 representation of the PSD(f) curves of ultraphobic surfaces according to the invention of Examples 12-13

Figure 5:
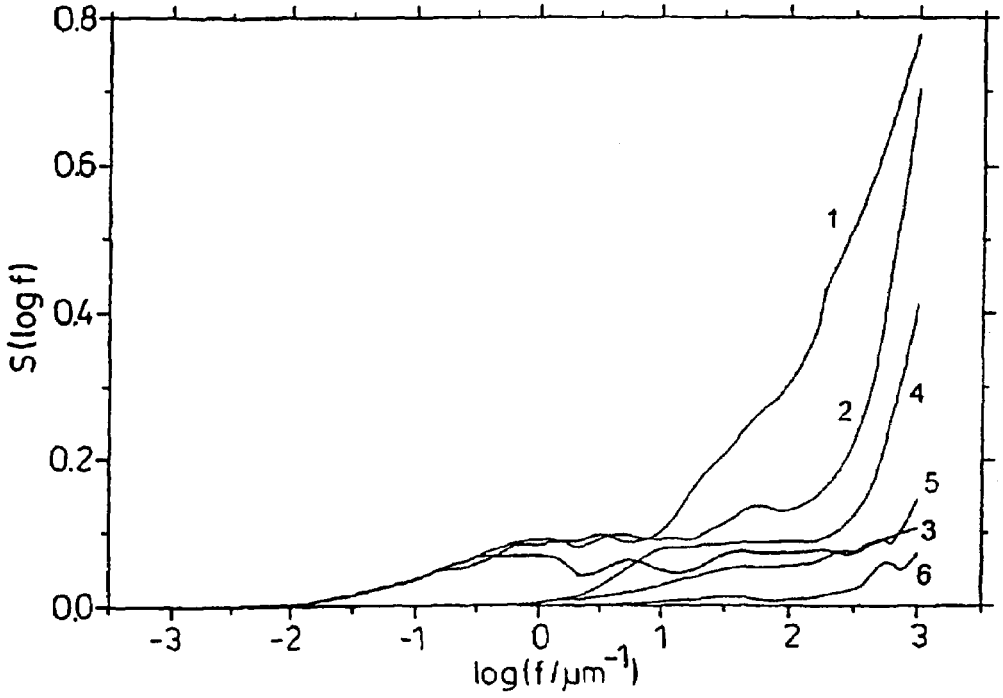

FIG. 5 representation of the frequency-dependent amplitudes a(f) of the Fourier components of surfaces according to the invention of Examples 1-6

Figure 6:
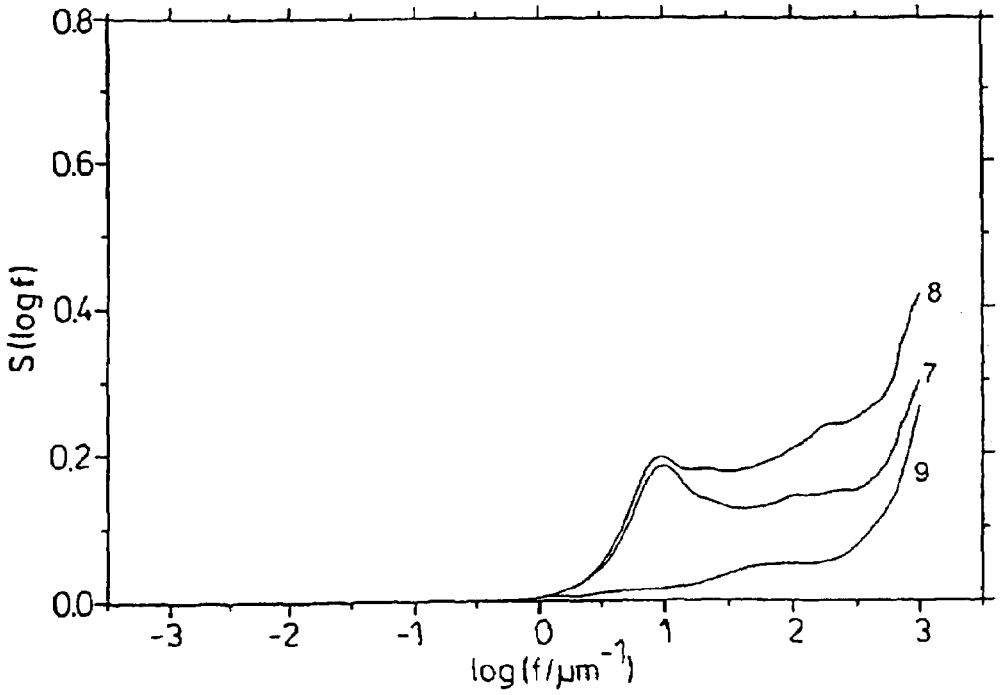

FIG. 6 representation of the frequency-dependent amplitudes a(f) of the Fourier components of surfaces according to the invention of Examples 7-9

Figure 7:
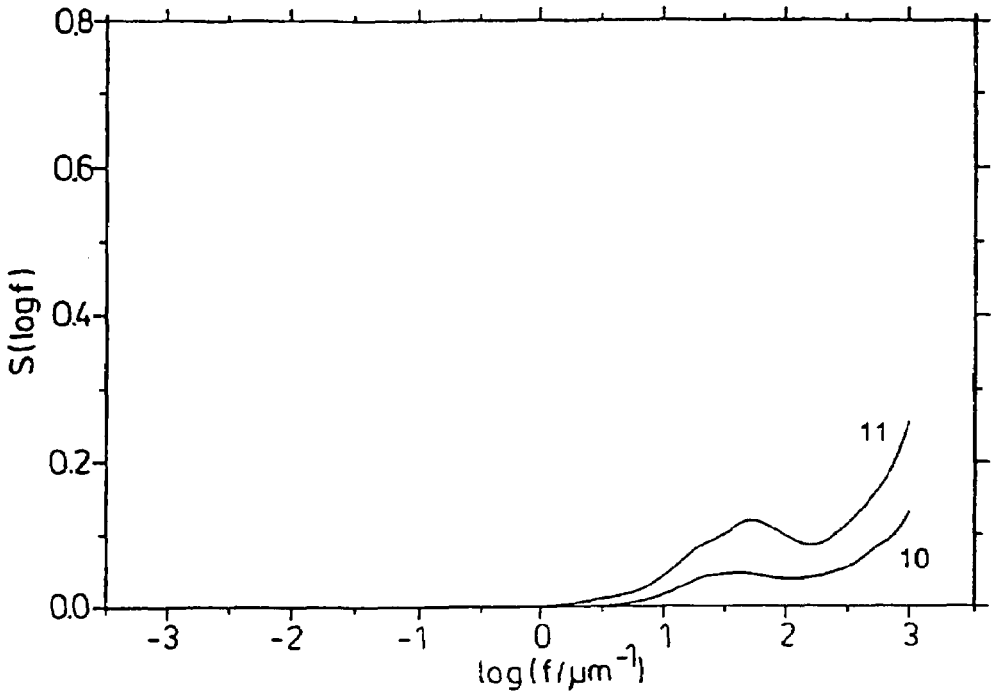

FIG. 7 representation of the frequency-dependent amplitudes a(f) of the Fourier components of surfaces according to the invention of Examples 10-11

Figure 8:
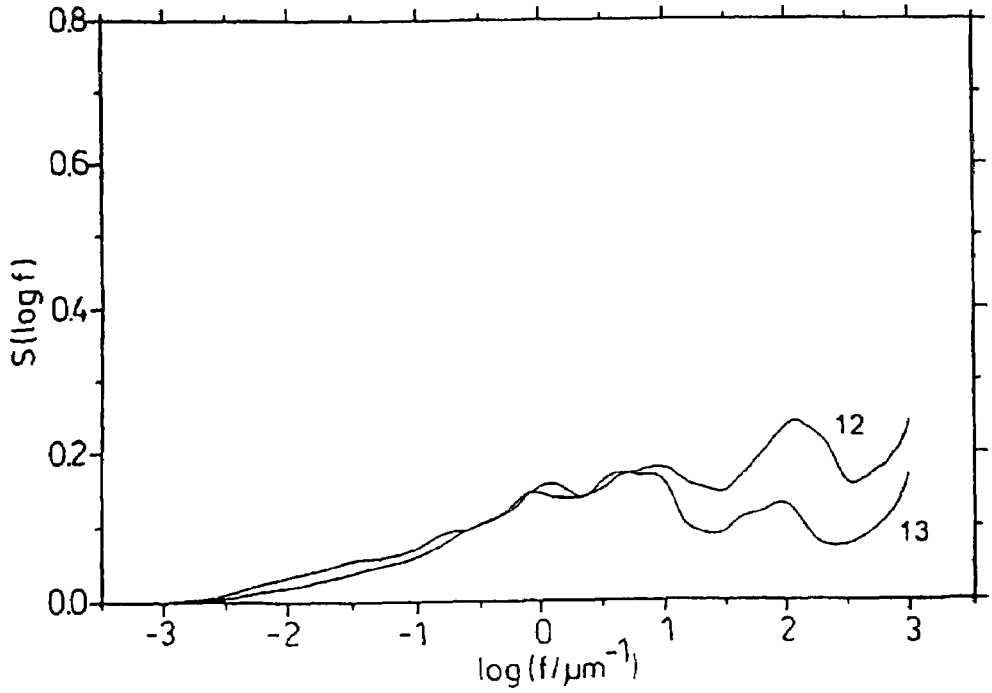

FIG. 8 representation of the frequency-dependent amplitudes a(f) of the Fourier components of surfaces according to the invention of Examples 12-13

Figure 9:
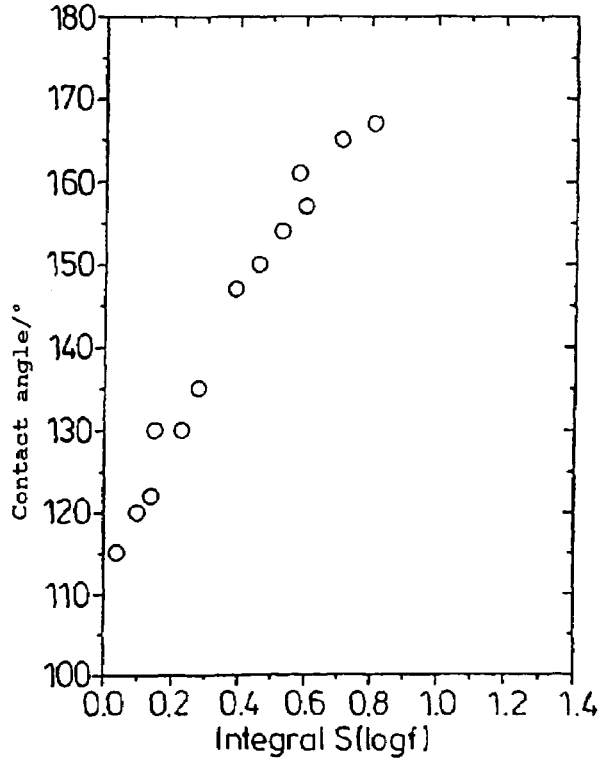

FIG. 9 representation of the water contact angle as a function of the integral of the function S(log f)=a(f)·f calculated between the integration limits $\log(f_1/\mu m^{-1})=-3$ and $\log(f_2\ \mu m^{-1})=3$ for the various example surfaces 1-13

FIG. 10 frequency-dependent amplitudes a(f) of the Fourier components of surfaces according to the invention of Examples 1-6 in the form F(log f) in log-log representation (corresponding to the representation in published German application DE 19860136 (U.S. application Ser. No. 09/869,123)).

FIG. 11 representation of the water contact angle as a function of the integral of the function F(log 1) calculated in the range of positive values of F in the interval $\log(f_1/\mu m^{-1})=-3$ and $\log(f_2/\mu m^{-1})=3$ for the various example surfaces 1-6 (corresponding to the representation in published German application DE 19860136 (U.S. application Ser. No. 09/869,123)).

FIG. 12 shows an ultrahydrophobic surface having hydrophilic areas thereon.

EXAMPLES

General Preliminary Remarks Regarding the Examples

1. Determination of the Surface Topography

To determine the surface topography, the surface was analyzed using a scanning tunneling microscope, using a scanning atomic force microscope, using white light interferometry and using angle-resolved light scattering.

For the scanning tunneling microscopy, a Nanoscope III, Digital Instruments, Santa Barbara, Calif. was used, which was operated in the constant flow mode. The measurement was carried out in air at room temperature using a mechanically drawn platinum-iridium tip. The scan areas $L^2$ used were, successively, the areas 500×500 $nm^2$, 200×200 nm and 50×50 $nm^2$ where in each case $N^2$=512×512 data points in step sizes ΔL=N/L.

The height profile data are converted to the averaged power spectral density PSD in accordance with equations 1 and 2 from the publication by C. Ruppe and A. Duparré, Thin Solid Films, 288, (1996), page 9.

Scanning atomic force microscopy was carried out using a DIMENSION 3000 scanning atomic force microscope from Digital Instruments, Santa Barbara, USA in contact mode. The measurement is carried out in air at room temperature. The Si tip has a radius of about 10 nm. The scan areas $L^2$ used are, successively, the areas 1×1 $\mu m^2$, 10×10 $\mu m^2$ and 50×50 $\mu m^2$ where in each case $N^2$=512×512 data points in step sizes ΔL=N/L.

For the white light interferometry, a LEICA DMR microscope from Leica, Wetzlar was used. The measurement fields were 140×140 $\mu m^2$, 280×2800 $\mu m^2$, 1120×1120 $\mu m^2$ and 2800×2800 $\mu m^2$ with in each case 512×512 data points.

The PSD(Δf) curves obtained using the abovementioned measurement methods were then combined to give a single PSD(f) curve and plotted log-log according to FIGS. 1-4, where the power spectral density PSD in $nm^4$ and the spatial frequency f in $\mu m^{-1}$ was made dimensionless.

2. Calculation of the Frequency-Dependent Amplitudes a(f):

The frequency-dependent amplitudes a(f) are determined from the PSD(f) curves according to the following formula.

$$a(f)=\sqrt{4\pi\int_{f-i\sqrt{D}}^{f\sqrt{D}}PSD(f')f'df'}\approx 2f\sqrt{\pi PSD(f)\log D}$$

In all cases, the constant D, which determines the integration interval width and within which the function PSD(f) is regarded as constant, used here was the value D=1.5.

This formula corresponds in principle to the calculation of spatial-frequency-dependent amplitudes, which is also described in J. C. Stover, Optical Scattering, 2nd Edition, SPIE Press Bellingham, Wash., USA 1995 in formula (4.19) on page 103, and in Table 2.1 on page 34 and Table 2.2 on page 37.

Example 1

A roll-polished AlMg3 sheet with an area of 35×35 $mm^2$ and a thickness of 0.5 mm was degreased with distilled chloroform, then for 20 s in aqueous NaOH (5 g/l) at 50° C.

The sheet was then prepickled for 20 s in $H_3PO_4$ (100 g/l), rinsed for 30 s in distilled water and electrochemically pickled for 90 s in a mixture of $HC1/H_3BO_3$ (in each case 4 g/l) at 35° C. and 120 mA/cm$^2$ at an alternating voltage of 35 V.

After the sheet had been rinsed in distilled water for 30 s and alkaline-rinsed in aqueous NaOH (5 g/l) for 30 s, it was again rinsed in distilled water for 30 s and then anodically oxidized for 90 s in $H_2SO_4$ (200 g/l) at 25° C. with 30 mA/cm$^2$ at a direct voltage of 50 V.

The sheet was then rinsed for 30 s in distilled water, then for 60 s at 40° C. in $NaHCO_3$ (20 g/l), then again for 30 s in distilled water and dried for 1 hour at 80° C. in a drying cabinet.

The sheet treated in this way was coated with an approximately 50 nm-thick gold layer by atomization. The sample was then coated for 24 hours by immersion in a solution of n-decanethiol in ethanol (1 g/l) at room temperature in a sealed vessel, then rinsed with ethanol and dried.

The surface has a static contact angle for water of 167°. A drop of water of volume 10 μl rolls off if the surface is inclined by <10°.

The surface topography of this surface was analyzed as described in "1. Determination of the surface topography", and the measurement data obtained [lacuna] plotted as curve 1 in FIG. 1.

The integral of the normalized Fourier amplitudes S(log f), calculated between integration limits $\log(f_1/\mu m^{-1})=-3$ and $\log(f_2/\mu m^{-1})=3$, is 0.81.

Example 2

In this example an $AlMg_3$ sheet was treated and coated exactly as in Example 1, although in addition, prior to the gold coating, the sheet was etched for 20 s in 1 M NaOH, then rinsed for 30 s in distilled water, then in ethanol and dried for 1 hour at 80° C. in a drying cabinet.

The surface has a static contact angle for water of 161°. A drop of water of volume 10 μl rolls off if the surface is inclined by <10°.

The surface topography of this surface was analyzed as described in "1. Determination of the surface topography", and the measurement data obtained [lacuna] plotted as curve 2 in FIG. 1.

The integral of the normalized Fourier amplitudes S(log f), calculated between integration limits $\log(f_1/\mu m^{-1})=-3$ and $\log(f_2/\mu m^{-1})=3$, is 0.58.

Comparative Example 3

In this example an AlMg3 sheet was treated and coated exactly as in Example 2, although it was etched for 120 s in 1 M NaOH.

The surface has a static contact angle for water of 150°. A drop of water of volume 10 μl does not roll off if the surface is inclined by <10°.

The surface topography of this surface was analyzed as described in "1. Determination of the surface topography", and the measurement data obtained [lacuna] plotted as curve 1 in FIG. 3.

The integral of the normalized Fourier amplitudes S(log f), calculated between integration limits $\log(f_1/\mu m^{-1})=-3$ and $\log(f_2/\mu m^{-1})=3$, is 0.46.

Comparative Example 4

In this example a 35×35 mm$^2$ polycarbonate substrate of thickness 1 mm was coated with a 200 nm-thick aluminum layer for atomization. The sample was then treated for 30 minutes in distilled water at 100° C., then rinsed in distilled water at room temperature for 30 s and dried for 1 hour at 80° C. in a drying cabinet.

The sample treated in this way was coated with an approximately 50 nm-thick gold layer by atomization. Finally, the sample was coated for 24 hours by immersion in a solution of n-decanethiol in ethanol (1 g/l) at room temperature in a sealed vessel, then rinsed with ethanol and dried.

The surface has a static contact angle for water of 135°. A drop of water of volume 10 μl does not roll off if the surface is inclined by <10°.

The surface topography of this surface was analyzed as described in "1. Determination of the surface topography", and the measurement data obtained [lacuna] plotted as curve 4 in FIG. 1.

The integral of the normalized Fourier amplitudes S(log f), calculated between integration limits $\log(f_1/\mu m^{-1})=-3$ and $\log(f_2/\mu m^{-1})=3$, is 0.28.

Comparative Example 5

In this example a roll-polished AlMg3 sheet with an area of 35×35 mm$^2$ and a thickness of 0.5 mm was degreased with distilled chloroform. After rinsing in distilled water for 30 s, the sheet was then anodically oxidized for 600 s in $H_2SO_4$ (200 g/l) at 20° C. with 10 mA/cm$^2$ at a direct voltage of 35 V. The sheet was then rinsed in distilled water and dried for 1 hour at 80° C. in a drying cabinet.

The sheet treated in this way was coated with an approximately 50 nm-thick gold layer by atomization. The sample was then coated for 24 hours by immersion in a solution of n-decanethiol in ethanol (1 g/l) at room temperature in a sealed vessel, then rinsed with ethanol and dried.

The surface has a static contact angle for water of 122°. A drop of water of volume 10 μl does not roll off if the surface is inclined by <10°.

The surface topography of this surface was analyzed as described in "1. Determination of the surface topography", and the measurement data obtained [lacuna] plotted as curve 5 in FIG. 1.

The integral of the normalized Fourier amplitudes S(log f), calculated between integration limits $\log(f_1/\mu m^{-1})=-3$ and $\log(f_2/\mu m^{-1})=3$, is 0.14.

Comparative Example 6

An untreated polished monocrystalline Si wafer was coated with 200 nm of gold by vapour deposition, and the sample was coated for 24 hours by immersion in a solution of n-decanethiol in ethanol (1 g/l) at room temperature in a sealed vessel, then rinsed with ethanol and dried.

The surface has a static contact angle for water of 115°. A drop of water of volume does not roll off if the surface is inclined by <10°.

The surface topography of this surface was analyzed as described in "1. Determination of the surface topography", and the measurement data obtained [lacuna] plotted as curve 6 in FIG. 1.

The integral of the normalized Fourier amplitudes S(log f), calculated between integration limits $\log(f_1/\mu m^{-1})=-3$ and $\log(f_2/\mu m^{-1})=3$, is 0.04.

Comparative Example 7

In this example a 35×35 mm$^2$ polycarbonate substrate of thickness 1 mm was coated with a 100 nm-thick aluminum layer for atomization. The sample was then treated for 3 minutes in distilled water at 100° C., then rinsed in distilled water at room temperature for 30 s and dried for 1 hour at 80° C. in a drying cabinet.

The sample treated in this way was coated with an approximately 100 nm-thick gold layer by atomization. Finally, the sample was coated for 24 hours by immersion in a solution of n-decanethiol in ethanol (1 g/l) at room temperature in a sealed vessel, then rinsed with ethanol and dried.

The surface has a static contact angle for water of 147°. A drop of water of volume 10 μl does not roll off if the surface is inclined by <10°.

The surface topography of this surface was analyzed as described in "1. Determination of the surface topography", and the measurement data obtained [lacuna] plotted as curve 1 in FIG. 2.

The integral of the normalized Fourier amplitudes S(log f), calculated between integration limits $\log(f_1/\mu m^{-1})=-3$ and $\log(f_2/\mu m^{-1})=3$, is 0.39.

Example 8

In this example a sample was prepared exactly as in Example 7. However, in contrast to Example 7, the gold layer used had a thickness of 50 nm.

The surface has a static contact angle for water of 154°. A drop of water of volume 10 μl rolls off if the surface is inclined by <10°.

The surface topography of this surface was analyzed as described in "1. Determination of the surface topography", and the measurement data obtained [lacuna] plotted as curve 2 in FIG. 2.

The integral of the normalized Fourier amplitudes S(log f), calculated between integration limits $\log(f_1/\mu m^{-1})=-3$ and $\log(f_2/\mu m^{-1})=3$, is 0.53.

Comparative Example 9

In this example a roll-polished AlMg3 sheet with an area of 35×35 $mm^2$ and a thickness of 0.5 mm was degreased with distilled chloroform. The sample was then treated for 20 s in distilled water at 100° C. The sheet was then rinsed in ethanol and dried for 1 hour at 80° C. in a drying cabinet.

The sheet treated in this way was coated with an approximately 50 nm-thick gold layer by atomization. The sample was then coated for 24 hours by immersion in a solution of n-decanethiol in ethanol (1 g/l) at room temperature in a sealed vessel, then rinsed with ethanol and dried.

The surface has a static contact angle for water of 130°. A drop of water of volume 10 μl does not roll off if the surface is inclined by <10°.

The surface topography of this surface was analyzed as described in "1. Determination of the surface topography", and the measurement data obtained [lacuna] plotted as curve 3 in FIG. 2.

The integral of the normalized Fourier amplitudes S(log f), calculated between integration limits $\log(f_2/\mu m^{-1})=-3$ and $\log(f_2/\mu m^{-1})=3$, is 0.15.

Comparative Example 10

In this example a polished monocrystalline Si(100) wafer was coated with the layer sequence substrate-HLHL ($H=LaF_3$, $L=MgF_2$) by electron beam vaporization at a substrate temperature of 520 K. The individual layer thicknesses used were, for H, a thickness of 100 nm, and, for L, a thickness of 116 nm. The preparation corresponds to the publication by S. Jakobs, A. Duparré and H. Truckenbrodt, Applied Optics 37, 1180 (1998).

The sample treated in this way was coated with an approximately 50 nm-thick gold layer by atomization. Finally, the sample was coated for 24 hours by immersion in a solution of n-decanethiol in ethanol (1 g/l) at room temperature in a sealed vessel, then rinsed with ethanol and dried.

The surface has a static contact angle for water of 120°. A drop of water of volume 10 μl does not roll off if the surface is inclined by <10°.

The surface topography of this surface was analyzed as described in "1. Determination of the surface topography", and the measurement data obtained [lacuna] plotted as curve 1 in FIG. 3.

The integral of the normalized Fourier amplitudes S(log f), calculated between integration limits $\log(f_1/\mu m^{-1})=-3$ and $\log(f_2/\mu m^{-1})=3$, is 0.10.

Comparative Example 11

In this example a sample was prepared as in Example 10. However, instead of substrate-$(HL)^2$, the layer sequence here is substrate-$(HL)^8$.

The surface has a static contact angle for water of 130°. A drop of water of volume 10 μl does not roll off if the surface is inclined by <10°.

The surface topography of this surface was analyzed as described in "1. Determination of the surface topography", and the measurement data obtained [lacuna] plotted as curve 2 in FIG. 3.

The integral of the normalized Fourier amplitudes S(log f), calculated between integration limits $\log(f_1/\mu m^{-1})=-3$ and $\log(f_2/\mu m^{-1})=3$, is 0.23.

Example 12

In this example a sample was prepared in the same manner as described in the unpublished German patent application with the file reference 19935326.3. Cyclo-$\{SiO(CH_3)[(CH_2)_2Si(OH)(CH_3)_2]\}_4$ (below: D4-silanol) was prepared as described in DE 196 03 241.

4.1 g of AEROSIL® R 812 (Degussa) are dispersed in 28.5 g of 1-methoxy-2-propanol, 5.0 g of D4-silanol and 6.5 g of tetraethoxysilane. 1.1 g of 0.1 N p-toluenesulphonic acid are added thereto, and the mixture is stirred for one hour at room temperature (23° C.). The resulting coating solution is then applied to glass using a film-drawing frame in a wet-film thickness of 120 μm. After the volatile constituents had evaporated off at room temperature, the coating was cured in a convection drying cabinet at 130° C. for one hour in a convection drying cabinet.

The sample treated in this way was coated with an approximately 50 nm-thick gold layer by atomization. Finally, the sample was coated for 24 hours by immersion in a solution of n-decanethiol in ethanol (1 g/l) at room temperature in a sealed vessel, then rinsed with ethanol and dried.

The surface has a static contact angle for water of 165°. A drop of water of volume 10 μl rolls off if the surface is inclined by <10°.

The surface topography of this surface was analyzed as described in "1. Determination of the surface topography", and the measurement data obtained [lacuna] plotted as curve 1 in FIG. 4.

The integral of the normalized Fourier amplitudes S(log f), calculated between integration limits $\log(f_1/\mu m^{-1})=-3$ and $\log(f_2/\mu m^{-1})=3$, is 0.71.

Example 13

In this example a sample was prepared as in Example 12, where, instead of the addition of 1.1 g of p-toluenesulphonic acid, 2.3 g of HCl were added here.

The surface has a static contact angle for water of 157°. A drop of water of volume rolls off if the surface is inclined by <10°.

The surface topography of this surface was analyzed as described in "1. Determination of the surface topography", and the measurement data obtained [lacuna] plotted as curve 2 in FIG. 4.

The integral of the normalized Fourier amplitudes S(log f), calculated between integration limits $\log(f_1/\mu m^{-1})=-3$ and $\log(f_2/\mu m^{-1})=3$, is 0.60.

Table 1 summarizes once again the results of the examples according to the invention and of the comparative examples.

It is clear that only in the case of ultraphobic surfaces for which the contact angle of a water drop on the surface is >150° is the integral of the curve a(f)·f=S(log f), calculated between integration limits $\log(f_1/\mu m^{-1})=-3$ and $\log(f_2/\mu m^{-1})=3$, greater than or equal to 0.5.

A positive or negative impression of such an ultraphobic surface likewise produces a contact angle >150°.

TABLE 1

| | Contact angle | Integral |
|---|---|---|
| Example 1 | 167° | 0.81 |
| Example 2 | 161° | 0.58 |
| Comparative Example 3 | 150° | 0.46 |
| Comparative Example 4 | 135° | 0.28 |
| Comparative Example 5 | 122° | 0.14 |
| Comparative Example 6 | 115° | 0.04 |
| Comparative Example 7 | 147° | 0.39 |
| Example 8 | 154° | 0.53 |
| Comparative Example 9 | 130° | 0.15 |
| Comparative Example 10 | 120° | 0.10 |
| Comparative Example 11 | 130° | 0.23 |
| Example 12 | 165° | 0.71 |
| Example 13 | 157° | 0.60 |

Example 14

To coat a plate made of aluminum, first an epoxy-functional resin (KBD7142) was produced. For this a mixture of 30 g glycidyl methacrylate 70 g PFMA ($[C_9F_{19}CH_2CH_2O—CO—C(CH_3)=CH_2]$)

1 g AIBN (azobisisobutyronitrile)

100 g MIBK (methylisobutylketone)

was dripped into a flask over a period of 2 h at 90° and stirred for 16 h. Then 50 g of 1,1,2-trichlorotrifluoroethane was added.

Then, the KBD 7142 was dissolved 1:50 in MIBK (methylisobutylketone 100 ml) and 1 g of fine-particle $SiO^2$ of the type Aerosil R 812 (manufacturer Degussa, Hanau) added.

A 150×150 $mm^2$ substrate made of aluminum was sprayed with this solution.

The layer thickness was 50 μm. Then, the plate was allowed to flash off for 12 h at room temperature.

The contact angle of a water droplet lying on this surface was 174°, the roll-off angle of a water droplet with a volume of 10 μl was <5°.

The ultrahydrophobic coating of the A1 test plate was then partially stripped by means of laser ablation in order to use the test plate as a microtitre plate.

For this, a beam from an eximer laser focused by a lens with a focal length of f=100 mm at a wavelength of 248 nm with a surface power density of 0.5 $J/cm^{-2}$ was used.

In the plate, 64×64=4096 areas with a size of 20×20 $\mu m^2$ at distances of 2 mm each on a overall area of 126×126 $mm^2$ were irradiated with the laser. Then, water droplets with a volume of 500 nl were positioned on each on the irradiated areas by means of a pipette. The diameter of the water droplet was approximately 1 mm. The positioning of the droplets was performed by means of an automatic metering device with automated xy positioning. The droplets were fixed in a vibrationally stable manner to the hydrophilic areas and functioned as microtitre plate sample volumes for the performance of sample reactions. There was no side boundary to the volumes in the form of container walls since the spherical curvature held the droplets stable. The small hydrophilic defect in the surface (5×5 $\mu m^2$) fixed the droplet to the desired position.

The droplets were used, for example, to perform a colour reaction. The colour reaction may either be read out qualitatively (e.g. colour change) or it is also possible to perform a quantitative concentration determination by means of an absorption measurement as in conventional test plates.

Obviously, numerous modifications and variations of the present invention are possible in light of the above teachings. It is therefore to be understood that within the scope of the appended claims, the invention may be practiced otherwise than as specifically described herein.

The invention claimed is:

1. A surface structure with an ultrahydrophobic surface, wherein the surface structure comprises a plurality of distinct hydrophilic areas each having a surface area ranging from 1 $nm^2$ to 1 $\mu m^2$ present on the ultrahydrophobic surface, wherein (1) the ultrahydrophobic surface has a surface topography, in which the value of the integral of the function S(logf)=a(f)·f, giving a relationship between the spatial frequencies of the individual Fourier components and their amplitude a(f), is between the integration limits $\log(f_1/\mu m^{-1})=-3$ and $\log(f_2/\mu m^{-1})=3$, at least 0.5, (2) the ultrahydrophobic surface comprises an ultrahydrophobic material or is coated with an ultrahydrophobic material, and (3) when a water droplet with a volume of 10 μl is placed on the ultrahydrophobic surface and the ultrahydrophobic surface is tilted at an angle, the angle at which the droplet rolls-off the surface does not exceed 10°.

2. The surface structure according to claim 1, wherein the hydrophilic areas are distributed on the surface in a periodic manner.

3. The surface structure according to claim 2, wherein the hydrophilic areas distributed on the surface in a periodic manner have the same surface shape.

4. The surface structure according to claim 3, wherein the surface shape of each of the hydrophilic areas of the ultrahydrophobic surface is rectangular or circular.

5. The surface structure according to claim 1, wherein the surface area of each of the hydrophilic areas ranges from 1 $nm^2$ to 1 $\mu m^2$.

6. The surface structure according to claim 1, wherein each of the hydrophilic areas is positioned on the surface in such a way that the plurality of hydrophilic areas form a pattern.

7. A printing plate comprising the surface structure according to claim 1.

8. A microtitre plate comprising the surface structure according to claim 1.

* * * * *